United States Patent [19]

Miyakawa et al.

[11] 4,250,250

[45] Feb. 10, 1981

[54] PHOTOGRAPHIC PROCESS

[75] Inventors: Nobuhiro Miyakawa, Kobe; Hiroshi Kokado; Eiichi Inoue, both of Tokyo, all of Japan

[73] Assignee: Mita Industrial Company Limited, Osaka, Japan

[21] Appl. No.: 65,740

[22] Filed: Aug. 10, 1979

Related U.S. Application Data

[63] Continuation of Ser. No. 866,342, Jan. 3, 1978, abandoned, which is a continuation of Ser. No. 724,230, Sep. 17, 1976, abandoned.

[30] Foreign Application Priority Data

Sep. 22, 1975 [JP] Japan ..... 50-113675

[51] Int. Cl.[3] ..... G03C 5/24

[52] U.S. Cl. ..... 430/374; 430/406; 430/413; 430/414; 430/415; 430/433; 430/435; 430/440; 430/494; 430/495

[58] Field of Search ..... 96/48 R, 48 PD, 88, 96/27 E; 427/304; 430/374, 406, 413, 414, 415, 433, 435, 440, 494, 495

[56] References Cited

U.S. PATENT DOCUMENTS

| | | | |
|---|---|---|---|
| 3,562,005 | 2/1971 | De Angelo et al. | 430/413 |
| 3,825,424 | 7/1974 | Gracia et al. | 430/414 |

FOREIGN PATENT DOCUMENTS

| | | | |
|---|---|---|---|
| 1043250 | 9/1966 | United Kingdom | 430/413 |

OTHER PUBLICATIONS

Cotton: Advanced Inorganic Chemistry, Interscience Publishers, New York, pp. 481–482, Feb. 1967.

*Primary Examiner*—Won H. Louie, Jr.
*Attorney, Agent, or Firm*—Sherman & Shalloway

[57] ABSTRACT

A photographic process comprising exposing image-wise a photosensitive layer containing a divalent tin basic salt to actinic rays to form a pattern consisting of non-reducing exposed areas and reducing non-exposed areas and contacting the exposed photo-sensitive layer with a developer capable of forming or erasing color by reduction to thereby form a visible image corresponding to said non-exposed areas or said exposed areas.

16 Claims, 1 Drawing Figure

PHOTOGRAPHIC PROCESS

Figure 1:
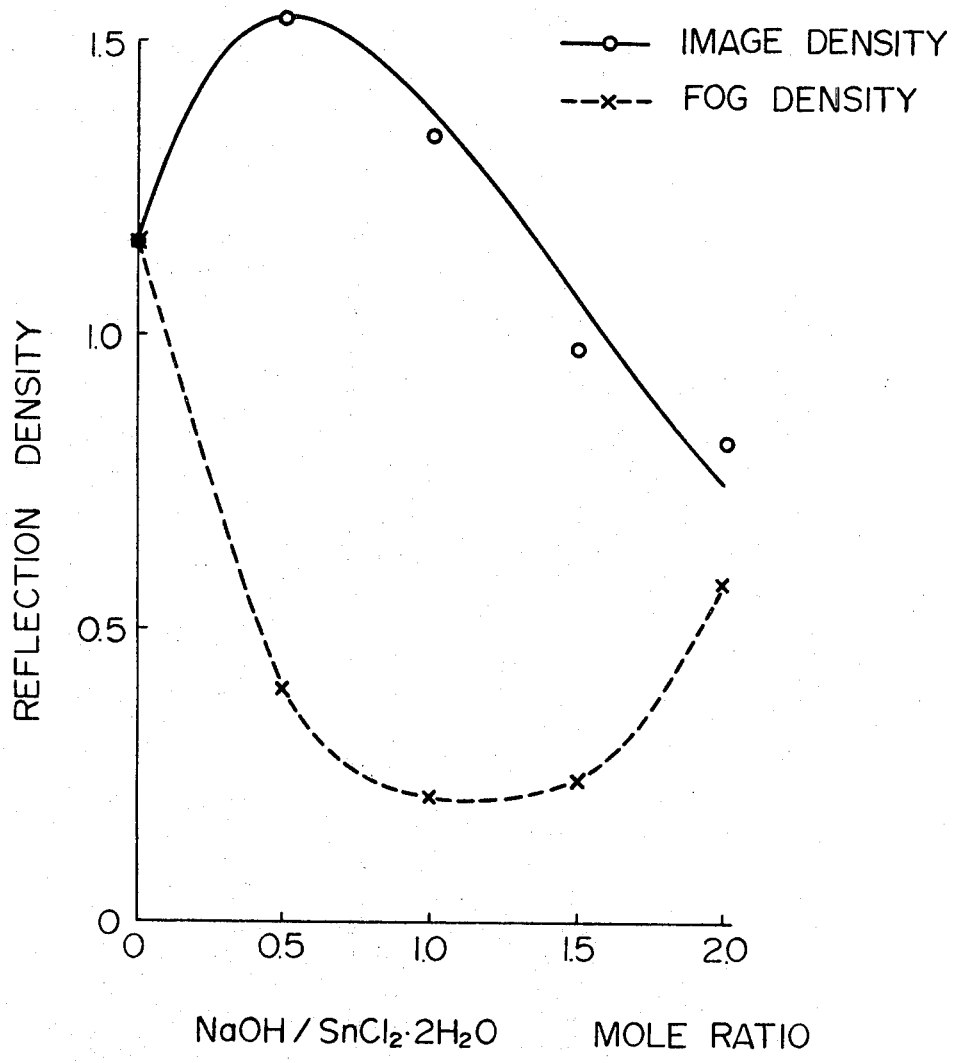

This is a continuation of application Ser. No. 866,342, filed Jan. 3, 1978 which in turn in a continuation of application Ser. No. 724,230, filed Sept. 17, 1976, both now abandoned.

This invention relates to a photographic process. More particularly, the invention relates to a photographic process according to which a positive image consistent with an original or original image, namely a so-called positive-positive image, can be obtained by one-staged exposure step and one-staged developing step.

As one photographic process, there has been known a process in which a photosensitive layer containing a semiconductor is exposed and the exposed photosensitive layer is reacted with an aqueous solution of a developer capable of forming color by reduction, for example, an aqueous solution containing ions of a noble metal such as silver, copper, gold, platinum, palladium or the like, to thereby form a visible image. This known process, however, is still insufficient in various points. For example, a visible image formed on the photosensitive layer is a negative image reverse to an original or original image, namely a positive-negative image, and according to this process, it is impossible to obtain directly a positive image. Further, when the semiconductor-containing photosensitive layer is reacted with a developer such as mentioned above after the exposure step, only a so-called latent image is formed, and in order to obtain a visible image having a sufficient image density, it is necessary to react the so treated photosensitive layer with another reducing agent.

We have found that a divalent tin basic salt, detailed hereinafter, readily loses its reducing activity if exposed to actinic rays, for example, ultraviolet rays and near-ultraviolet rays, and that when a photosensitive layer containing such divalent tin basic salt is imagewise exposed to actinic rays, a latent image consisting of non-reducing exposed areas and reducing non-exposed areas is formed and if this exposed photosensitive layer is contacted with a developer capable of forming or erasing color by reduction, an image having a sufficient density and a high contrast, preferably a positive image, can be directly formed by this one-staged developing operation.

It is therefore a primary object of this invention to provide a novel photographic process according to which a clear image, especially a positive image consistent with an original or original image, can easily be obtained by one-staged exposure step and one-staged developing step.

Another object of this invention is to provide a novel photographic process using in combination a photosensitive layer containing a divalent tin basic salt and a developer capable of forming or erasing color by reduction.

In accordance with this invention, there is provided a photographic process comprising exposing imagewise a photosensitive layer containing a divalent tin basic salt to actinic rays to form a pattern consisting of non-reducing exposed areas and reducing non-exposed areas and contacting the exposed photosensitive layers with a developer capable of forming or erasing color by reduction to thereby form a visible image corresponding to said non-exposed areas or said exposed areas.

In this invention, in order to form definitely a pattern consisting substantially non-reducing exposed areas and substantially reducing non-exposed areas at the exposure step, it is necessary to use a divalent tin basic salt as the photosensitive substance. A divalent tin normal salt, such as tin (II) halide, does not lose its reducing activity even by exposure to actinic rays as illustrated in Comparative Example 1 given hereinafter. Accordingly, in this case, it is difficult to form a pattern such as mentioned above on the photosensitive layer. Further, a completely hydrolysed salt, i.e., tin (II) hydroxide, can produce an image after the above-mentioned exposure and developping steps, but the image density is extremely low and the fog density is high. Therefore, such salt is not preferred for attaining the objects of this invention. In order to obtain a pattern such as mentioned above, it is necessary that tin of the tin salt used should be divalent. As illustrated in Comparative Example 2, when a tetravalent tin compound is used, no colored image can be obtained at the developing step.

In this invention, by the term "basic salt" is meant a salt containing an acid group and a hydroxyl group or oxygen atom that can be regarded as an anionic component independent from the acid group. The proportion of these two components can be changed in a broad range so as to obtain an optimum combination of the photosensitivity and contrast. In general, it is preferred that a divalent tin basic salt having the following composition be used:

$$SnO.mSnX_{2/k} \quad (1)$$

wherein X stands for an acid radical, m is a number larger than 0 but smaller than 5, especially a number in the range of from 0.3 to 2, and k stands for the valency of the acid radical X.

Tin (II) compounds in which the value of m is outside the above range have a lower sensitivity to light than tin (II) compounds having a composition included in the scope defined by above formula (1).

As the acid radical X, there can be mentioned halide ions such as fluorine ion, chlorine ion and bromine ion, anions of acidic oxides such as carbonic ion, nitric ion, nitrous ion, sulfuric ion, sulfurous ion, phosphoric ion, phosphorous ion, pyrophosphoric ion, boric ion and silicic ion, and organic anions such as formic ion and acetic ion. In view of the photosensitivity, halide ions, especially chlorine ion, are preferred.

A tin (II) compound most important for attaining the objects of this invention is tin (II) oxychloride.

This tin (II) oxychloride includes various compounds differing in the composition, and for example, compounds having the following composition are known, though the tin (II) oxychloride that can be used in this invention is not limited to these compounds:

$SnO.SnCl_2.3H_2O$,
$4SnO.SnCl_2.6H_2O$,
$3SnO.2SnCl_2.6H_2O$,
$5SnO.3SnCl_2.3H_2O$,
$7Sn(OH)_2.2SnCl_2$ and
$3Sn(OH)_2.SnCl_2$.

These compounds may be used singly or mixtures of two or more of these compounds may be used. Further, mixtures of these compounds with tin (II) chloride or tin (II) hydroxide can be used.

In general, these tin (II) oxychlorides take a form of white or light yellow fine powder and they are crystalline.

The basic tin (II) salt that is used in this invention can be prepared by (1) boiling an aqueous solution of a water-soluble tin (II) salt such as tin (II) chloride to partially hydrolyze the salt or (2) reacting an aqueous solution of a water-soluble tin (II) salt such as tin (II) chloride with an alkaline agent in an amount smaller than the equivalent amount to thereby partially hydrolyze the salt. In view of the stability of the obtained image, the yield of the basic tin (II) salt and the easiness of the operation, the latter method (2) is preferred.

As the alkaline agent that is preferably used in the method (2), there can be mentioned hydroxides, carbonates and bicarbonates of alkali metals such as sodium, potassium and lithium, ammonia, ammonium carbonate, and hydroxides, water-soluble carbonates and bicarbonates of alkaline earth metals such as magnesium, calcium, strontium and barium. Such alkaline agent is used in an amount of 0.2 to 1 equivalent, preferably 0.4 to 0.8 equivalent, to the water-soluble tin (II) salt.

The effects attained by this invention will now be described by reference to the accompanying drawing, in which FIG. 1 is a diagram illustrating relations of the mole ratio of the alkaline agent to the water-soluble tin (II) salt in production of the divalent tin basic salt, to the image density and the fog density.

FIG. 1 illustrates relations of the mole ratio of the used alkaline agent to the image density and the fog density in the image on a photosensitive layer, which is obtained through the exposure and developing steps. From results shown in FIG. 1, it will readily be understood that when the alkaline agent is used in an amount of 0.4 to 0.8 equivalent, the image density can be improved while reducing the fog density and an image having a highest contrast can be obtained.

Incidentally, FIG. 1 illustrates results obtained when tin oxychloride prepared in the same manner as in Referential Example 1 except that the mole ratio of the alkaline agent to stannous chloride is changed is used, a photosensitive material is prepared in the same manner as in Example 1 by using this tin oxychloride and this photosensitive material is exposed and developed under the same conditions as described in Example 1.

In practising the above method (2), in general, an aqueous solution containing a soluble tin salt such as tin (II) halide at a concentration of 2 to 10 moles per liter is prepared, this solution is mixed with an aqueous solution of an alkaline agent such as mentioned above under cooling, for example, at a temperature lower than room temperature, the reaction product is promptly filtered in 20 minutes from the start of mixing, and the recovered product is washed with distilled water or alcohol. When the reaction is conducted for a long time or at a high temperature, such undesired phenomena as reduction of the photosensitivity of the product and coloration of the background of the photosensitive layer are often caused to occur. Therefore, it is not preferred to conduct the reaction under such conditions. The separated and washed basic tin (II) salt is used in the as-obtained paste form or after drying as the photosensitive substance for production of a photosensitive layer.

In order to obtain a desirable combination of the sensitivity and resolving power, the basic tin (II) salt may be used in the form of a high sensitivity composition composed of relatively coarse particles having, for example, a size of 0.5 to 3$\mu$ or in the form of a high resolving power composition composed of relatively fine particles having, for example, a size smaller than 0.5$\mu$.

As the coating medium to be used for formation of a photosensitive layer, there can be mentioned water, organic solvents and high-molecular-weight vehicles dissolved or dispersed in these solvents. For example, a photosensitive material is prepared by dispersing the above-mentioned divalent tin basic salt in water or in an organic solvent and coating the resulting dispersion on a substrate such as paper. Of course, a high-molecular-weight binder can be incorporated in such solvent so as to impart abrasion resistance and peel resistance to the resulting photosensitive layer.

As the organic solvent, there can be mentioned, for example, alcohols such as methanol, ethanol, butanol, ethylene glycol, propylene glycol, glycerin, methyl cellosolve, butyl cellosolve and diacetone alcohol, ethers such as diethyl ether, tetrahydrofuran and dioxane, ketones such as methylethyl ketone and acetone, N,N-substituted amides such as dimethyl formamide and dimethyl acetamide, sulfoxides such as dimethyl sulfoxide, aromatic hydrocarbon solvents such as benzene, toluene, xylene and long-chain alkyl benzenes, aliphatic hydrocarbons such as n-hexane and iso-paraffinic hydrocarbons, and halogenated hydrocarbons such as carbon tetrachloride, methylene chloride, chloroform, trichlene and chlorobenzene. These organic solvents may be used singly or in combination, or they may be used in the form of mixtures with water if desired.

As the high-molecular-weight binder to be incorporated into such solvent, there can be mentioned water-soluble high-molecular-weight substances, oil-soluble high-molecular-weight substances and water-emulsifiable high-molecular-weight substances. As examples of the water-soluble high-molecular-weight substance, there can be mentioned starch, cyanoethylated starch, carboxymethyl cellulose, methyl cellulose, ethyl cellulose, tragacanth gum, gum arabic, polyvinyl alcohol, sodium alginate, polyvinyl pyrrolidone, sodium polyacrylate, sodium polymethacrylate, sodium polyvinylsulfonate, sodium polyvinyltoluenesulfonate, gelatin, vinyl ether-maleic acid copolymers, maleic oil, water-soluble acrylic resins and polyacrylamide. As examples of the water-emulsifiable high-molecular-weight substance, there can be mentioned polyvinyl acetate emulsions, vinyl chloride-vinyl acetate copolymer emulsions, styrene-butadiene copolymer emulsions, acrylic resin emulsions and polyethylene emulsions. As examples of the oil-soluble high-molecular-weight substance, there can be mentioned acrylic resins, polyvinyl chloride, polyvinylidene chloride, vinyl acetate resins, vinyl acetal resins, polystyrene, alkyd resins, xylene resins, phenolic resins, melamine resins, urea resins, epoxy resins, polyamide resins, silicone resins, shellac and synthetic rubbers.

It is preferred that a divalent tin basic salt be incorporated in such coating medium in an amount of 10 to 50% by weight, especially 15 to 30% by weight (all of "%" and "parts" given hereinafter are by weight unless otherwise indicated). It is also preferred that the high-molecular-weight binder be incorporated in an amount of 5 to 40 parts, especially 10 to 30 parts, per 100 parts of the basic tin (II) salt.

In view of the sensitivity, it is preferred to use a photosensitive composition formed by incorporating a water-soluble or water-emulsifiable high-molecular-weight binder into an aqueous medium, namely water or a mixed solvent of water and a water-miscible organic solvent. In view of the stability of the image formed by the developing operation described below, it is preferred to use a composition formed by dissolving or dispersing an oil-soluble high-molecular-weight binder into an oily solvent, namely an organic solvent. In case of the former composition, in order to prevent peeling of the photosensitive layer or re-dissolution of the photosensitive layer at the developing step, it is preferred to gel or harden the coating layer by known means.

Known sensitizers, desensitizers, fog preventing agents and pigments may be incorporated into the photosensitive composition of this invention according to a known recipe.

The above-mentioned photosensitive composition is coated on the surface of an optional substrate, for example, a fibrous substrate such as paper, cloth or non-woven fabric, a resin film or sheet, a metal foil or sheet, or a glass sheet, and then, the coated composition is dried to form a photosensitive layer. The thickness of the photosensitive layer containing a hydroxide or basic salt of tin (II) may optionally be adjusted so as to prevent coloration of the background and obtain a prescribed image density. In general, the thickness of the coating is adjusted to less than 5μ, and good results are obtained when the thickness of the coating is less than 3μ, especially in the range of 0.5 to 2 μ.

The photosensitive composition of this invention has a sensitivity to near-ultraviolet rays and ultraviolet rays, especially those having a wave length of 260 to 450 mμ. When the photosensitive layer is exposed to rays having a wave length in the above-mentioned range, in exposed areas the reducing property of the basic tin (II) salt is substantially lost by photodecomposition but in non-exposed areas the reducing property of the basic tin (II) salt is substantially retained.

As the light source for exposure of the photosensitive layer, there can be used light sources emitting ultraviolet rays or near-ultraviolet rays, for example, a low pressure mercury lamp, a high pressure mercury lamp, an arc lamp, a hydrogen discharge tube, a xenon lamp, a krypton lamp, a gallium lamp, a fluorescent lamp and sunbeams. For example, a photosensitive layer comprising the photosensitive composition of this invention has such a sensitivity that when it is supplied and exposed in a printing zone of a commercial diazo-type copying machine provided with an ordinary mercury lamp or fluorescent lamp, an image having a sufficient image density is obtained.

Such exposure processes as contact exposure, transmission exposure, reflection printing and image pick-up exposure can be adopted for exposure of the photosensitive layer. Further, the photosensitive layer may be subjected to slit exposure or entire surface exposure by using a combination of a light source and an optical system. In this case, a necessary exposure quantity can easily be determined depending on such factors as desired image density and contrast, the kind of the tin (II) compound and the wave length of the light source by simple experiments.

According to the present invention, the thus exposed photosensitive layer is contacted with a known developer capable of forming or erasing color by reduction, and a visible image corresponding to the non-exposed or exposed areas can be thus obtained.

Such developer to be used in this invention is known in the art, and any of known developers can optionally be used for attaining the objects of this invention. Suitable examples are as follows:

(A) Reducing metal ion-containing salts:

Water-soluble salts, especially nitrates, halides and acetates, of metals of Group Ib or IIb of the Periodic Table such as silver ($Ag^+$), gold ($Au^+$ and $Au^{3+}$), mercury ($Hg^{2+}$) and copper ($Cu^{2+}$), and of metals of the platinum group such as palladium ($Pd^{4+}$ and $Pd^{2+}$) and platinum ($Pt^{4+}$ and $Pt^{2+}$).

(B) Molybdic acid, phosphomolybdic acid, silicomolybdic acid and their water-soluble salts (such as alkali metal salts and ammonium salts).

(C) Alkali ferricyanides and water-soluble ferric salts (such as ammonium ferric citrate, ammonium ferric oxalate, ferric chloride and ferric nitrate).

(D) Brucine and its derivatives (such as cacotheline).

(E) Oxidative reducing dyes such as Methylene Blue, Safranine T and indigo-sulfonic acid (when these dyes are used, negative images are formed).

In general, such developer is applied to the exposed photosensitive material in the form of an aqueous solution or a solution in a mixed solvent of water and a water-miscible organic solvent such as alcohol. The concentration of the developer in such solution can optionally be determined so as to obtain desirable image concentration and contrast. In general, the concentration is chosen in the range of from 0.05 to 5% according to the kind of the developer.

The temperature and time necessary for development are experimentally determined depending on the kind and thickness of the photosensitive layer and the kind and concentration of the developer so as to obtain a desirable combination of the image density and contrast. In general, the development is carried out at a temperature of 0° to 30° C. for a reaction time of 0.5 second to 5 minutes. For example, when the above-mentioned developer (A) or (B) is employed, it is advantageous to select a lower temperature or a shorter time in the above range, and when the developer (E) is used, good results are obtained when a higher temperature or a longer time is chosen in the above range.

The development can be accomplished very easily by dipping the photosensitive layer in a solution of the developer or by coating a solution of the developer on the photosensitive layer by known coating means such as roller coating, spray coating or brush coating. After the development, if desired, the photosensitive layer is washed with water to effect fixation.

According to the photographic process of this invention, a photocopy having high image density and high contrast can be directly formed by one-staged exposure operation and one-staged development operation. Further, there is attained an advantage that so-called positive-positive images can be directly obtained. Still in addition, this invention is industrially advantageous in that a photosensitive layer that is used in this invention is available at a low cost.

This invention will now be described in detail by reference to the following examples that by no means limit the scope of the invention. In these examples, all of "%" and "parts" are by weight unless otherwise indicated.

REFERENTIAL EXAMPLE 1

In 80 ml of water was dissolved 2 g of NaOH, and while the liquid temperature was kept below 20° C., an aqueous solution of 11.3 g of $SnCl_2.2H_2O$ in 10 ml of water was poured little by little into the above solution. The mixture was slightly agitated and then subjected to suction filtration, and the filtered solid was washed with small amounts of water and alcohol. The washed solid was dried to obtain 4.7 g of a light yellow product. In this reaction, the mole ratio of $SnCl_2.2H_2O$:NaOH was 1:1.

REFERENTIAL EXAMPLE 2

In the same manner as in Referential Example 1, 11.3 g of $SnCl_2.2H_2O$ was reacted with 4.2 g of KOH (the mole ratio of $SnCl_2.2H_2O$:KOH being 1:1.5) to obtain 6.0 g of a light yellow product.

REFERENTIAL EXAMPLE 3

In the same manner as in Referential Example 1, 11.3 g of $SnCl_2.2H_2O$ (dissolved in 10 ml of water) was reacted with 7.5 g of $KHCO_3$ (dissolved in 200 ml of water) (the mole ratio of $SnCl_2.2H_2O$:$KHCO_3$ being 1:1.5) to obtain 6.8 g of a light yellow product.

REFERENTIAL EXAMPLE 4

In the same manner as in Referential Example 1, 11.3 g of $SnCl_2.2H_2O$ was reacted with 3.9 g of $Na_2CO_3$ (the mole ratio of $SnCl_2.2H_2O$:$Na_2CO_3$ being 1:0.75) to obtain 6.1 g of a light yellow product.

REFERENTIAL EXAMPLE 5

In the same manner as in Referential Example 1, 7 g of $SnBr_2$ was reacted with 1 g of NaOH (the mole ratio of $SnBr_2$:NaOH being 1:1) to obtain 3.5 g of a light yellow product.

REFERENTIAL EXAMPLE 6

With 120 ml of water was diluted 10 ml of aqueous ammonia (containing 28 to 30% of $NH_3$), and while the liquid temperature was kept below 20° C., an aqueous solution of 11.3 g of $SnCl_2.2H_2O$ in 10 ml of water was poured into the above diluted solution. The mixture was slightly agitated and then subjected to suction filtration, and the recovered solid was washed with small amounts of water and alcohol and dried at 40° C. to obtain 5.8 g of a light yellow product.

REFERENTIAL EXAMPLE 7

In the same manner as in Referential Example 1, 8 g of $SnF_2$ was reacted with 3.1 g of $LiOH.H_2O$ (the mole ratio of $SnF_2$:$LiOH.H_2O$ being 1:1.5) to obtain 4.8 g of a light yellow prouct.

REFERENTIAL EXAMPLE 8

In 100 ml of water was dissolved and dispersed 1.9 g of $Ca(OH)_2$, and at room temperature an aqueous solution of 11.3 g of $SnCl_2.2H_2O$ in 10 ml of water was poured into the resulting liquid. The mixture was agitated for 3 minutes and then subjected to suction filtration. The recovered solid was washed with small amounts of water and alcohol and dried at 40° C. to obtain 4.7 g of a light yellow product. In this reaction, the mole ratio of $SnCl_2.2H_2O$:$Ca(OH)_2$ was 1:0.5.

REFERENTIAL EXAMPLE 9

In 300 ml of water was dissolved and dispersed 2.3 g of $3MgCO_3.Mg(OH)_2.3H_2O$ and at room temperature an aqueous solution of 11.3 g of $SnCl_2.2H_2O$ in 10 ml of water was poured into the above liquid. The mixture was agitated for 3 minutes and then subjected to suction filtration. The recovered solid was washed with small amounts of water and alcohol and dried at 40° C. The product was white before drying but became light yellow after drying. The yield of the product was 5.0 g.

COMPARATIVE EXAMPLE 1

In 4 g of a methanol solution containing 5% of a polyvinyl acetate resin was dissolved 1 g of $SnCl_2.2H_2O$, and the resulting solution was coated on a Mylar film by using a wire bar so that the dry thickness was 1$\mu$. The so obtained coated film was subjected to exposure for 30 minutes in the state contacted closely with a positive film original by using a high pressure mercury lamp as a light source, and then, the exposed coated film was dipped in an aqueous solution containing 1% of phosphomolybdic acid. The entire coated surface was colored in blue but no image was formed.

COMPARATIVE EXAMPLE 2

In the same manner as in Referential Example 1, 17.5 g of $SnCl_4.5H_2O$ was reacted with 5 g of NaOH to obtain 5.1 g of a white product. By using the so obtained product, the test was carried out in the same manner as in Comparative Example 1. No image was formed at all on the coated surface.

EXAMPLE 1

A mixture comprising 10 g of the compound obtained in Referential Example 1, 5 g of a methanol solution containing 50% of a polyvinyl acetate resin and 30 g of tetrahydrofuran was dispersed for 24 hours in a ball mill. The resulting coating liquid was coated on a Mylar film by a wire bar, followed by drying, to obtain a photosensitive material including a photosensitive layer having a dry thickness of 1$\mu$. This photosensitive material was closely contacted with a positive film original, and the assembly was exposed to rays of a high pressure mercury lamp spaced by 30 cm from the assembly for 1 minute. The exposed photosensitive material was dipped in a 1% aqueous solution of phosphomolybdic acid for 5 seconds, washed with water and dried to obtain a blue positive image quite in agreement with the original.

EXAMPLE 2

A photosensitive material was prepared in the same manner as in Example 1 by using the compound obtained in Referential Example 2. The photosensitive material was closely contacted with a positive film original and exposed for 30 seconds to rays of a fluorescent lamp for diazo-type photography which was spaced by 10 cm from the photosensitive material. Then, the exposed photosensitive material was dipped in a 1% aqueous solution of phosphomolybdic acid for 5 seconds, washed with water and dried to obtain a blue positive image consistent to the original and having a high contrast.

EXAMPLE 3

A mixture comprising 10 g of the compound obtained in Referential Example 3, 10 g of a 20% toluene solution of a polystyrene resin and 30 g of methylethyl ketone was dispersed for 24 hours in a ball mill, and the resulting coating liquid was coated on baryta paper so that the dry thickness of the coating was 1$\mu$. The resulting photosensitive material was closely contacted with a positive film original and passed through a commercial diazo-type copying machine (Copystar Superdash 4A) to effect exposure. Then, the exposed photosensitive material was dipped in a 1% aqueous solution of silver nitrate for 5 seconds and washed with a 5% aqueous solution of oxalic acid to obtain a brown positive image highly consistent with the original, which had a high resolving power and a high contrast without substantial fog.

EXAMPLE 4

In the same manner as in Example 1, a photosensitive material was prepared by using the compound obtained in Referential Example 4. The resulting photosensitive material was closely contacted with a positive film original and exposed to rays of a high pressure mercury lamp spaced by 30 cm from the photosensitive material for 1.5 minutes. The exposed photosensitive material was dipped for 10 seconds in a liquid developer comprising 0.8 g of potassium ferricyanide, 1.3 g of ammonium iron (III) citrate and 100 ml of water to obtain a blue positive image consistent with the original.

EXAMPLE 5

A mixture comprising 10 g of the compound obtained in Referential Example 5, 10 g of a 20% acetone solution of a polyvinyl butyral resin and 25 g of acetone was dispersed in a ball mill, and the resulting coating liquid was coated and dried on baryta paper (the dry thickness of the coating being 1μ). The so obtained photosensitive material was exposed in the same manner as in Example 2, dipped in a 1% aqueous solution of molybdic acid for 5 seconds, washed with water and dried to obtain a dark green positive image.

EXAMPLE 6

A mixture comprising 10 g of the compound obtained in Referential Example 6, 10 g of a 20% tetrahydrofuran solution of a styrene-butadiene copolymer and 25 g of toluene was dispersed in a ball mill, and the resulting coating liquid was coated and dried on tracing paper (the dry thickness of the coating being 1.2μ). The so obtained photosensitive material was closely contacted with a positive film original and exposed to rays of a fluorescent lamp for diazo-type photography spaced by 10 cm from the photosensitive material for 1 minute. Then, the exposed photosensitive material was dipped for 20 seconds in a dispersion of 0.5 g of cacotheline in 100 ml of water, washed with water and dried to obtain a violet positive image consistent with the original.

EXAMPLE 7

In the same manner as in Example 3, a photosensitive material was prepared by using the compound obtained in Referential Example 7. Then, the photosensitive material was subjected to light exposure, development and washing to obtain a brown positive image consistent with the original, which had a high resolving power and a high contrast.

EXAMPLE 8

A mixture comprising 10 g of the compound obtained in Referential Example 8, 13 g of a 20% methylethyl ketone solution of a polyvinyl butyral resin and 20 g of methyl ethyl ketone was dispersed in a ball mill and the resulting coating liquid was coated and dried on an artificial paper (the dry thickness of the coating being 1μ). The so obtained photosensitive material was closely contacted with a positive film original and exposed for 35 seconds to rays of a fluorescent lamp for diazo-type photography spaced by 10 cm from the photosensitive material. When the exposed photosensitive material was dipped in a dispersion of 1 g of ammonium phosphomolybdate in 100 ml of water, ammonium phosphomolybdate adhered to the coated surface of the photosensitive material and a green positive image highly consistent with the original was obtained.

EXAMPLE 9

A photosensitive paper was prepared in the same manner as in Example 9 by using the compound obtained in Referential Example 9. This photosensitive paper was contacted with a positive original and passed through a copying machine for diazo-type photography. The exposed photosensitive paper was dipped for 5 seconds in a 1% aqueous solution of phosphomolybdic acid, washed with water and dried to obtain a blue positive image consistent with the original.

What is claimed is:

1. A photographic process comprising exposing a photosensitive layer comprising particles of a divalent tin basic salt dispersed in a high-molecular-weight binder to actinic rays having a wave length in the range of 260 to 450 mμ to form a pattern consisting of nonreducing exposed areas and reducing nonexposed areas, said particles of the divalent tin basic salt being obtained by reacting an aqueous solution of a water-soluble tin (II) salt with an alkaline agent in an amount of 0.4 to 0.8 equivalent to partially hydrolyze said water-soluble tin salt, said divalent tin basic salt having a sensitivity only to rays having a wave length in the range of 260 to 450 mμ, said high molecular weight binder being present in an amount of 5 to 40 parts by weight per 100 parts by weight of the divalent tin basic salt, and developing the exposed photosensitive layer by contacting said layer with a developer capable of forming or erasing color by reduction to thereby form a visible image corresponding to said non-exposed area or said exposed area, said developer being selected from the group consisting of (A) water-soluble salts containing a reducing metal ion, (B) molybdic acid, phosphomolybdic acid, silicomolybdic acid and water-soluble salts thereof, (C) combinations of alkali ferricyanides with water-soluble ferric salts, (D) brucine, cacotheline, and (E) oxidative reducing dyes.

2. A process according to claim 1 wherein said particles of the divalent tin basic salt have a particle size of 0.5 to 3μ.

3. A process according to claim 1 wherein said particles of the divalent tin basic salt have a particle size smaller than 0.5μ.

4. A process according to claim 1 wherein said particles of the divalent tin basic salt are crystalline.

5. A process according to claim 1 wherein said high-molecular-weight binder is an oil-soluble high-molecular-weight resin.

6. A process according to claim 1 wherein said high-molecular-weight binder is a water-soluble or water-emulsifiable resin.

7. A process according to claim 1 wherein said photosensitive layer is applied in a thickness of 0.5 to 5μ to a substrate.

8. A photographic process according to claim 1 wherein the alkaline agent is selected from the group consisting of alkali metal hydroxide, alkali metal carbonate, alkali metal bicarbonate, ammonia, ammonium carbonate, alkaline earth metal hydroxide, water-soluble alkaline earth metal carbonate, and water-soluble alkaline earth metal bicarbonate.

9. A photographic process according to claim 2 in which the divalent tin basic salt particles are present in the photosensitive layer in an amount from 10 to 50% by weight.

10. A photographic process according to claim 3 in which the divalent tin basic salt particles are present in the photosensitive layer in an amount from 10 to 50% by weight.

11. The photographic process according to claim 1 wherein the developer is said (A) water-soluble salt containing a reducing metal ion selected from the group consisting of nitrates, halides and acetates of silver ($Ag^+$), gold ($Au^+$ and $Au^{3+}$), mercury $Hg^{2+}$), copper ($Cu^{2+}$), palladium ($Pd^{4+}$ and $Pd^{2+}$) and platinum ($Pt^{4+}$ and $Pt^{2+}$).

12. The photographic process according to claim 1 wherein said developer is selected from the group (B).

13. The photographic process according to claim 1 wherein said developer is selected from the group (C) wherein said alkali ferricyanide is ammonium ferric citrate or ammonium ferric oxalate and said water-soluble ferric salt is ferric chloride or ferric nitrate.

14. The photographic process according to claim 1 wherein said developer is selected from the group (D).

15. The photographic process according to claim 1 wherein said developer is selected from the group (E) wherein said oxidative reducing dye is Methylene Blue, Safranine T or indigo-sulfonic acid.

16. The photographic process according to claim 1 wherein the exposed photosensitive layer is contacted with said developer at a temperature of 0° to 30° C. for a reaction time of 0.5 second to 5 minutes.

* * * * *